US006319049B1

(12) United States Patent
Lee

(10) Patent No.: US 6,319,049 B1
(45) Date of Patent: Nov. 20, 2001

(54) CONNECTOR ASSEMBLY HAVING FLEXIBLE PULL TAPE

(75) Inventor: George Lee, Taipei (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/602,106

(22) Filed: Jun. 21, 2000

(51) Int. Cl.[7] ..... H01R 13/00
(52) U.S. Cl. ..... 439/484; 439/405
(58) Field of Search ..... 439/484, 483, 439/405, 404

(56) References Cited

U.S. PATENT DOCUMENTS 6,059,604 * 5/2000 Juntwait et al. ..... 439/404
6,074,237 * 6/2000 Lee ..... 439/405
6,126,479 * 10/2000 Lee ..... 439/484
6,132,241 * 5/2000 Hwang ..... 439/405

* cited by examiner

*Primary Examiner*—Gary Paumen
(74) *Attorney, Agent, or Firm*—Wei Te Chun

(57) ABSTRACT

An electrical connector assembly (1) includes an electrical connector (20), a cover (30) coupled to the connector and a flexible pull tape (40) assembled to the cover and the connector. The flexible pull tape includes a pair of hollow frames (42) each having an upper bar (421) and a lower bar (422). The upper bar forms a protruding lid (4211) for engaging with a slot (33) of the cover and the lower bar forms a pair of barbs (4221) for mating with grooves (2113) defined in the housing. The flexible pull tape further includes a leash (41) connecting the pair of hollow frames at opposite ends thereof and provides a convenient device for a user to exert a pulling force on the electrical connector assembly to disengage the electrical connector assembly from a mating connector.

1 Claim, 5 Drawing Sheets

CONNECTOR ASSEMBLY HAVING FLEXIBLE PULL TAPE

BACKGROUND OF THE INVENTION

1. Field of the Invention

The present invention relates to an electrical connector assembly, and particularly to an electrical connector assembly having a flexible pull tape.

2. Description of the Related Art

A conventional electrical cable connector assembly for a flat cable usually comprises an electrical connector including electrical contacts, each having an engaging end for engaging with a corresponding conductor of a flat cable by Insulation Displacement Connection (IDC) and a mating end for mating with electrical contacts of a complementary connector. A cover presses the flat cable to the electrical connector. In addition, a pull mechanism is usually provided for users to disengage the electrical connector assembly from the complementary connector where a low profile electrical connector assembly is concerned. The low profile connectors comply with miniaturization trends in the electronic field but access for users to disengage a low profile electrical connector assembly from a complementary connector is often difficult. The pull mechanism is usually provided between the cover and the connector or secured only to the cover, thereby resulting in deterioration of the engagement between the cover and the connector. Furthermore, the engagement of the pull mechanism with the electrical connector is not so reliable as desired since, as is known, the pull force needed to disengage an electrical connector assembly from a complementary connector is relatively large. Therefore, an improved electrical connector assembly is required to overcome the disadvantages described above.

SUMMARY OF THE INVENTION

A first object of the present invention is to provide an electrical connector assembly having a reliable pull tape, which not only self locks to an electrical connector and a dielectric cover but also secures the cover to the connector;

A second object of the present invention is to provide a pull tape for an electrical connector assembly, the pull tape facilitating users to disengage the electrical connector assembly from a mating connector.

To fulfill the above objects, an electrical connector assembly in accordance with the present invention comprises an electrical connector, a dielectric cover, and a flexible pull tape.

The electrical connector comprises an insulative elongated housing and a plurality of conductive contacts. The housing comprises a pair of opposite longitudinal ends and each longitudinal end forms a protruding block on an upper section thereof. Each protruding block defines a groove in a lower surface thereof and forms a pair of ribs vertically projecting sideward therefrom. Each electrical contact comprises a mating end for mating with electrical contacts of a complementary connector and an engaging end for engaging with conductors of a flat cable.

The dielectric cover comprises a lower surface having a configuration corresponding to the flat cable to tightly press the flat cable to the housing and to reliably position the conductors of the flat cable for ensuring reliable electrical connection between the conductors and the engaging ends of the electrical contacts. The cover defines a pair of slots extending from the lower surface to a top surface thereof on either longitudinal end thereof. The cover comprises a pair of cover ribs corresponding to the ribs of the protruding block and a projecting lid having a projecting hook thereunder to be fitted within one groove of the insulative housing. The longitudinal ends of the cover ribs are flush with the ribs of the protruding blocks of the housing.

The flexible pull tape is made of high performance plastic material, such as Nylon. The flexible pull tape comprises a pair of hollow rectangular frames for surrounding the protruding blocks of the housing and the longitudinal ends of the cover, and a flexible leash connecting the pair of rectangular frames at two opposite ends thereof. The rectangular frames of the flexible pull tape each comprises an upper bar forming a protruding lid for engaging with the slot of the cover and a lower bar forming a pair of barbs for locking with the groove of the housing.

Other objects, advantages and novel features of the invention will become more apparent from the following detailed description of the present embodiment when taken in conjunction with the accompanying drawings.

DETAILED DESCRIPTION OF THE INVENTION

Figure 1:
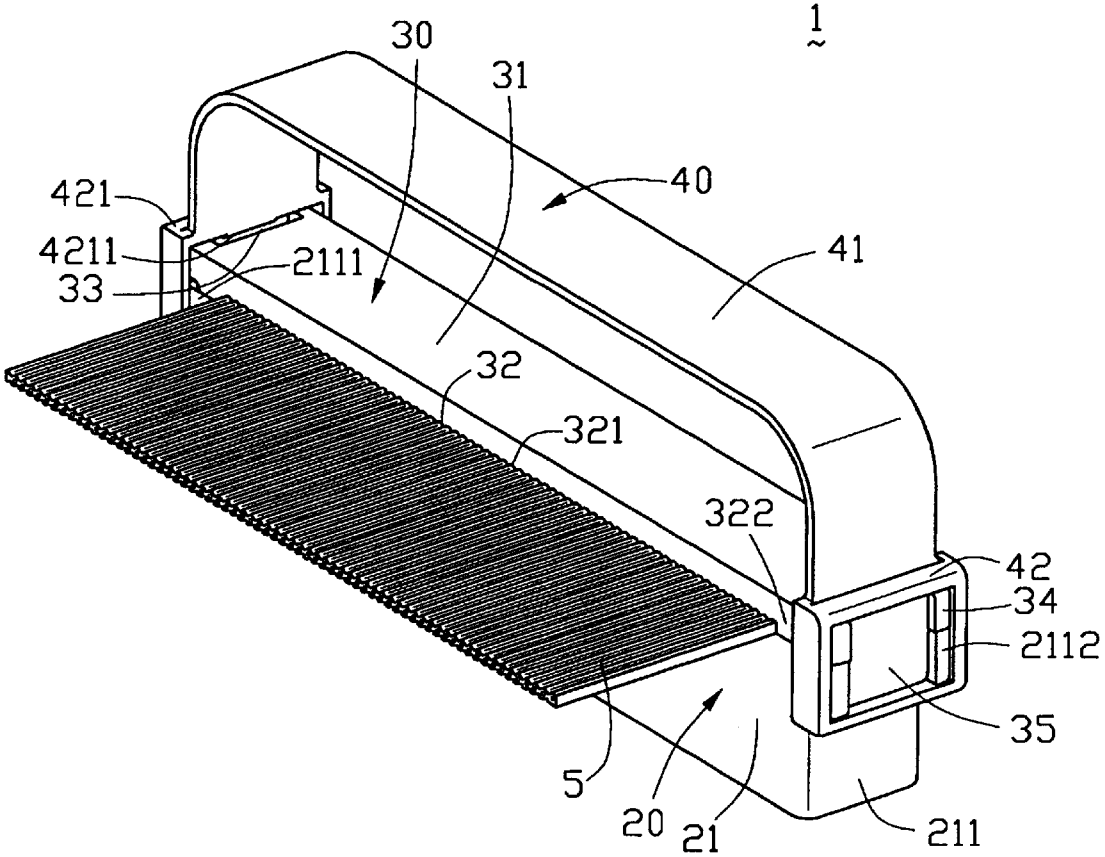
FIG. 1 is a perspective view of an electrical connector assembly in accordance with the present invention.

Referring to FIG. 1, an electrical connector assembly 1 in accordance with the present invention comprises an electrical connector 20, a dielectric cover 30 securing a flat cable 5 to the electrical connector 20, and a flexible pull tape 40.

Figure 2:
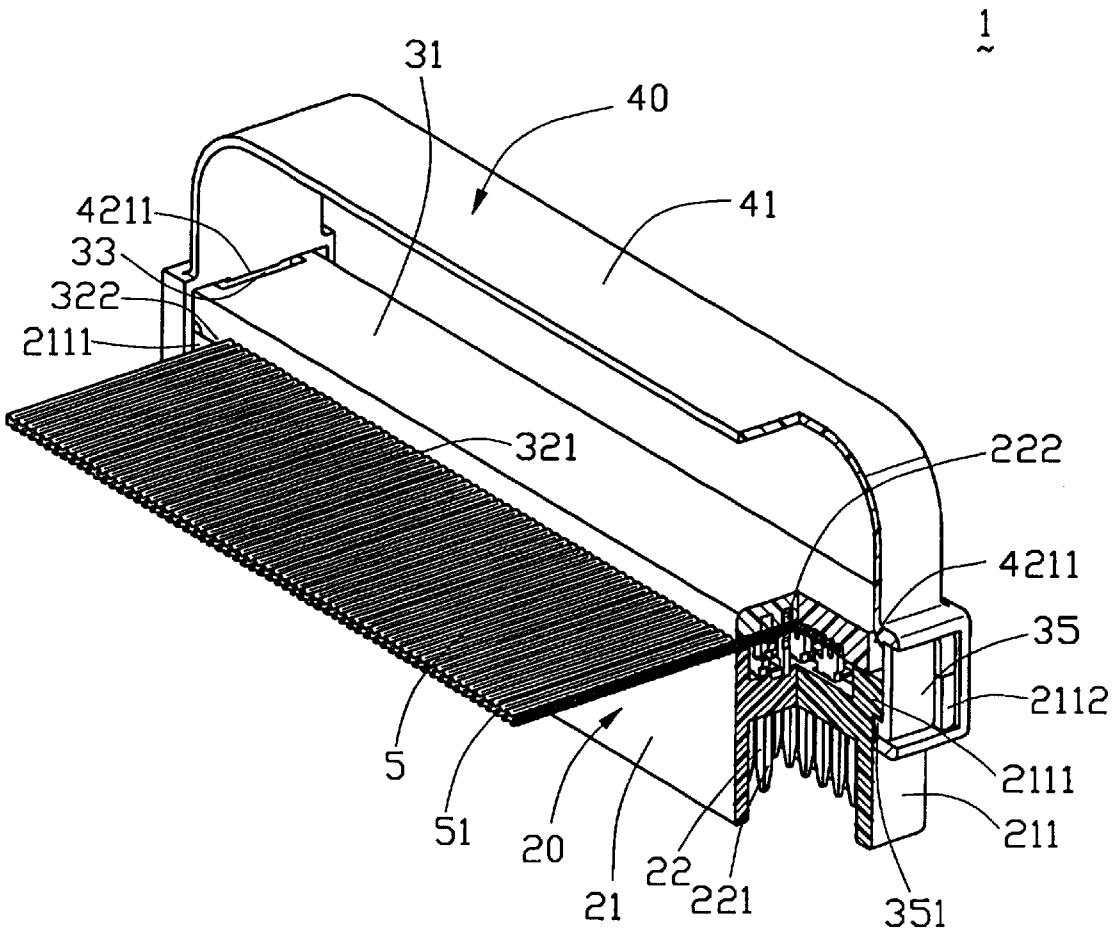
FIG. 2 is a partially cutaway view of FIG. 1 showing contacts of a housing and an engagement of a flexible pull tape with a cover.
Figure 3:
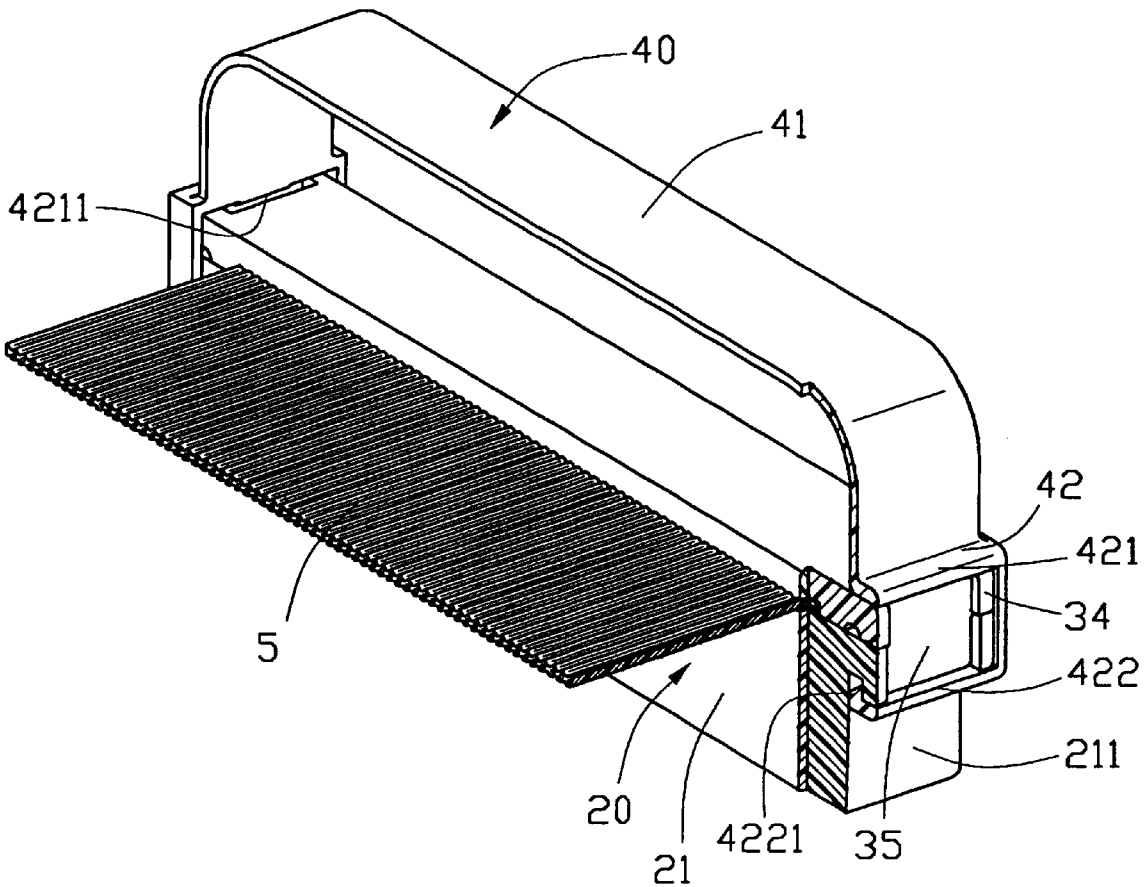
FIG. 3 is a partially cutaway view of FIG. 1 showing an engagement of the flexible pull tape with a housing.
Figure 4:
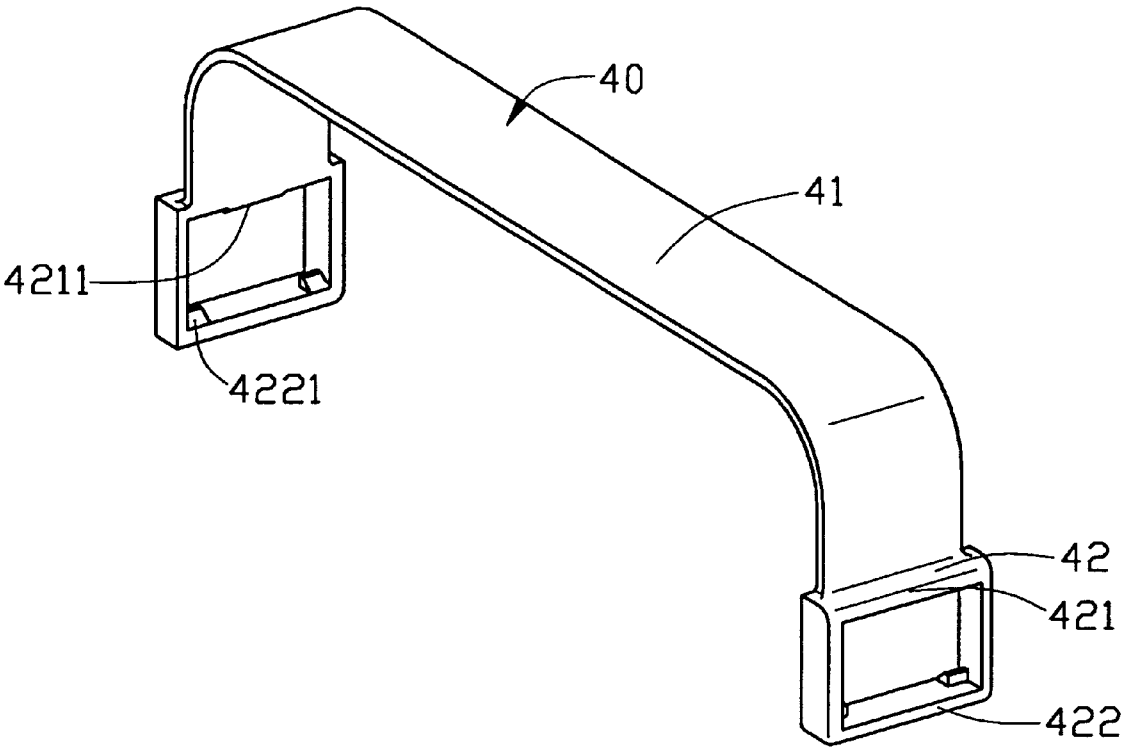
FIG. 4 is a perspective view of the flexible pull tape.
Figure 5:
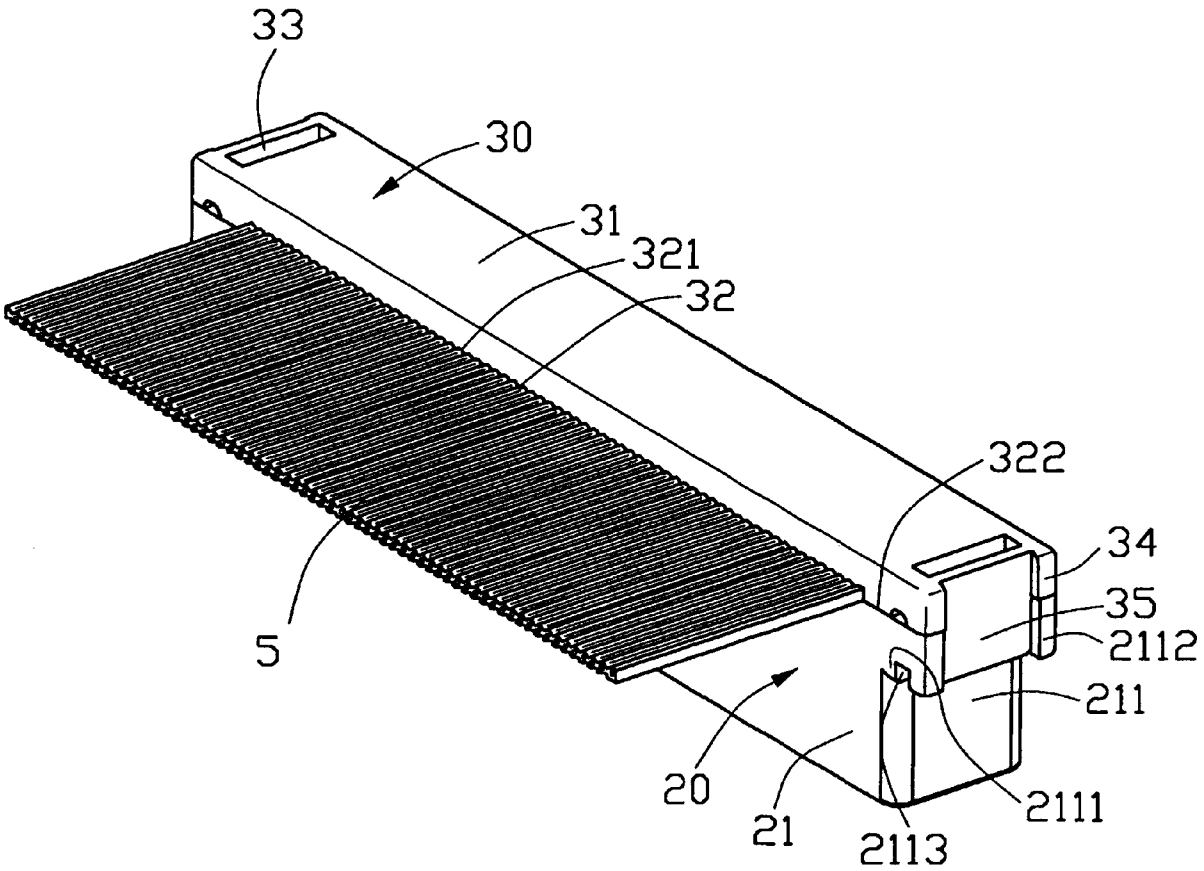
FIG. 5 is a perspective view showing the cover and the electrical connector.

Referring specifically to FIGS. 1, 2 and 5, the electrical connector 20 comprises an insulative housing 21 and a plurality of electrical contacts 22. The insulative housing 21 comprises a pair of opposite longitudinal ends 211, each of which forms a protruding block 2111 on an upper section thereof Each protruding block 2111 forms a pair of ribs 2112 vertically projecting sideward therefrom and defines a groove 2113 in a lower surface thereof. Each of the electrical contacts 22 comprises a mating end 221 for engaging with electrical contacts (not shown) of the complementary connector (not shown) and an engaging end 222 for engaging with conductors 51 of the flat cable 5. The engagement of the engaging ends 222 with the conductors 51 of the flat cable 5 is in Insulation Displacement Connection (IDC) fashion.

The cover 30 is generally in the shape of an elongated plate and comprises an upper surface 31 and a lower surface 32. The upper surface 31 forms a pair of slots 33 extending through to the lower surface 32. The lower surface 32 comprises a plurality of recesses 321 configured to correspond to the shape of the conductors 51 of the flat cable 5 to properly position the conductors 51, and a pair of shoulders 322. The shoulders 322 form a space (not labeled) between the recesses 321 and an upper surface of the housing 21 for accommodating the flat cable 5. Cover ribs 34 are formed one the ends of the cover 30 corresponding to the ribs 2112 of the housing 20. The longitudinal ends of the cover ribs 34 fit flush with the ribs 2112 of the protruding blocks 2111 of the housing 20. The cover 30 further forms a projecting lid 35 extending downwardly therefrom between the cover ribs 34 at either longitudinal end thereof. A projecting hook 351 is formed at a lower end of each projecting lid 35, protruding inwardly.

Referring specifically to FIGS. 1–4, the flexible pull tape 40 is made of high performance plastic material, such as Nylon, and comprises a flexible leash 41 and a pair of hollow rectangular frames 42 formed at two opposite ends of the leash 41. The hollow frames 42 each comprise an upper bar 421 and a lower bar 422. The upper bar 421 forms a protruding lid 4211 extending downwardly from a central section thereof and the lower bar 422 forms a pair of barbs 4221 extending upwardly therefrom.

In assembly, the flat cable 5 is put on the upper surface of the housing 21. The cover 30 is then pressed to the housing 21 to cause the engaging ends 222 of the electrical contacts to have an IDC with the conductors 51 of the flat cable 5, wherein the engaging ends 222 and conductors 51 are respectively received by the recesses 321. The projecting hooks 351 of the projecting lids 35 of the cover 30 engage with the grooves 2113 of the insulative housing 21. Thus, the housing 21 and the cover 30 are fixedly connected together. Finally, the pull tape 40 is assembled to the housing 21 and the cover 30 by fitting the ribs 2112 of the housing 21 and the cover ribs 34 of the cover 30 into the hollow rectangular frames 42, respectively. When the housing 21, the cover 30 and the pull tape 40 are assembled together, the hollow frames 42 surround the longitudinal ends of the cover 30 and the protruding blocks 2111 of the insulative housing 21 to further lock the cover 30 and the housing 21 together. The protruding lids 4211 of the pull tape 40 extend into the slots 33 and the barbs 4221 fit within the grooves 2113. Thus, the connector assembly 1 can have a strongly connecting structure.

The improved structures of the frame 42, the cover 30 and the housing 21 provide reliable engagement therebetween. The flexible leash 41 provides a convenient device for a user to exert a pulling force on the connector assembly 1 to disengage the connector assembly 1 from a complementary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly for connecting a flat cable with a complementary electrical connector, comprising:

an electrical connector, comprising:

an insulative housing comprising a pair of transverse sides, each transverse side having a protruding block thereon; and a plurality of electrical contacts mounted in the insulative housing, each electrical contact comprising a mating end for engaging with electrical contacts of a complementary connector and an engaging end for connecting with electrical conductors of a flat cable;

an elongated dielectric cover for coupling the flat cable to the insulative housing; and a flexible pull tape locking with both the housing and the cover and providing a device for a user to pull the electrical connector assembly out of mating engagement with the complementary electrical connector; wherein the flexible pull tape is made of high performance plastic material;

wherein the flexible pull tape comprises a pair of hollow frames for surrounding the corresponding protruding blocks of the insulative housing and opposite longitudinal ends of the dielectric cover, and a flexible leash connecting the pair of frames;

wherein each frame comprises an upper bar forming a protruding lid extending downwardly therefrom and a lower bar forming at least a barb extending upwardly therefrom;

wherein the cover forms a pair of slots extending therethrough for engaging with the protruding lids of the flexible pull tape, respectively, and the protruding blocks of the housing define grooves for mating with the barbs of the flexible pull tape.

* * * * *